US005951131A

United States Patent [19]

Stefan

[11] Patent Number: 5,951,131

[45] Date of Patent: Sep. 14, 1999

[54] ENCLOSURE ASSEMBLY FOR THE EQUIPMENT OF A GAMING DEVICE OR THE LIKE

[76] Inventor: Alexander Stefan, 216 E. Arby, Las Vegas, Nev. 89119

[21] Appl. No.: 09/076,302

[22] Filed: May 11, 1998

[51] Int. Cl.[6] ..... A47B 43/00

[52] U.S. Cl. ..... 312/257.1; 312/263; 312/265.5

[58] Field of Search ..... 312/257.1, 263, 312/265.3, 265.5, 265.2

[56] References Cited

U.S. PATENT DOCUMENTS

| | | | |
|---|---|---|---|
| 2,424,217 | 7/1947 | Bales | 312/257.1 |
| 2,651,557 | 9/1953 | Kelly, Jr. | 312/257.1 |
| 2,732,273 | 1/1956 | Schaffner | 312/257.1 |
| 2,808,944 | 10/1957 | Jones et al. | 312/257.1 X |
| 3,337,983 | 8/1967 | Ebstein | 312/263 X |
| 3,347,609 | 10/1967 | Mann | 312/263 |
| 3,371,977 | 3/1968 | McCabe | 312/257.1 |
| 3,378,320 | 4/1968 | Morgan et al. | 312/257.1 X |
| 3,856,371 | 12/1974 | Forsyth | 312/257.1 X |
| 4,134,624 | 1/1979 | Moyer | 312/257.1 X |
| 4,265,500 | 5/1981 | Berton et al. | 312/263 X |
| 4,453,789 | 6/1984 | Gullong | 312/257.1 X |
| 4,540,222 | 9/1985 | Burrell | 312/257.1 |
| 4,726,636 | 2/1988 | Voigt et al. | 312/257.1 |
| 4,786,122 | 11/1988 | Nichoalds | 312/257.1 |
| 4,836,626 | 6/1989 | Taylor et al. | 312/257.1 |
| 4,848,859 | 7/1989 | Edmonds et al. | 312/257.1 |
| 5,435,255 | 7/1995 | Elseser et al. | 312/257.1 X |
| 5,496,105 | 3/1996 | Czarnecky et al. | 312/263 X |
| 5,713,649 | 2/1998 | Swift | 312/265.5 X |
| 5,797,665 | 8/1998 | Jeter | 312/257.1 X |

FOREIGN PATENT DOCUMENTS

| | | | |
|---|---|---|---|
| 1333618 | 6/1963 | France | 312/257.1 |
| 1477091 | 3/1967 | France | 312/265.5 |
| 3025962 | 2/1982 | Germany | 312/263 |
| 620551 | 3/1949 | United Kingdom | 312/257.1 |
| 655870 | 8/1951 | United Kingdom | 312/257.1 |
| 94/16598 | 8/1994 | WIPO | 312/257.1 |

*Primary Examiner*—Peter M. Cuomo
*Assistant Examiner*—Rodney B. White

[57] ABSTRACT

Disclosed is a modular assembly for an enclosure for the equipment of a device, such as a gaming device, the assembly comprising panels that are adapted to be affixed to each other quickly and easily to form an enclosure using fasteners such as pop rivets in a manner that conceals the fasteners from view, and includes a top, bottom, back, and opposing side panels, each panel having four sides, a planar portion, and flanged edges along each side. A first type of flanged edge is bent through two right angles to provide one flanged member perpendicular to the planar portion and a second flange member spaced from, and parallel to the planar portion, and having holes spaced apart there along. The other type of panel edge is a single lip at right angles to the periphery to the planar portion and it has a plurality of spaced-apart holes along is length. The panels have an assembled position wherein the flange holes of each panel are aligned with flange holes of an adjacent panel and fasteners such as pop rivets are affixed through the aligned holes to secure the enclosure in its assembled position.

8 Claims, 2 Drawing Sheets

FIG—7
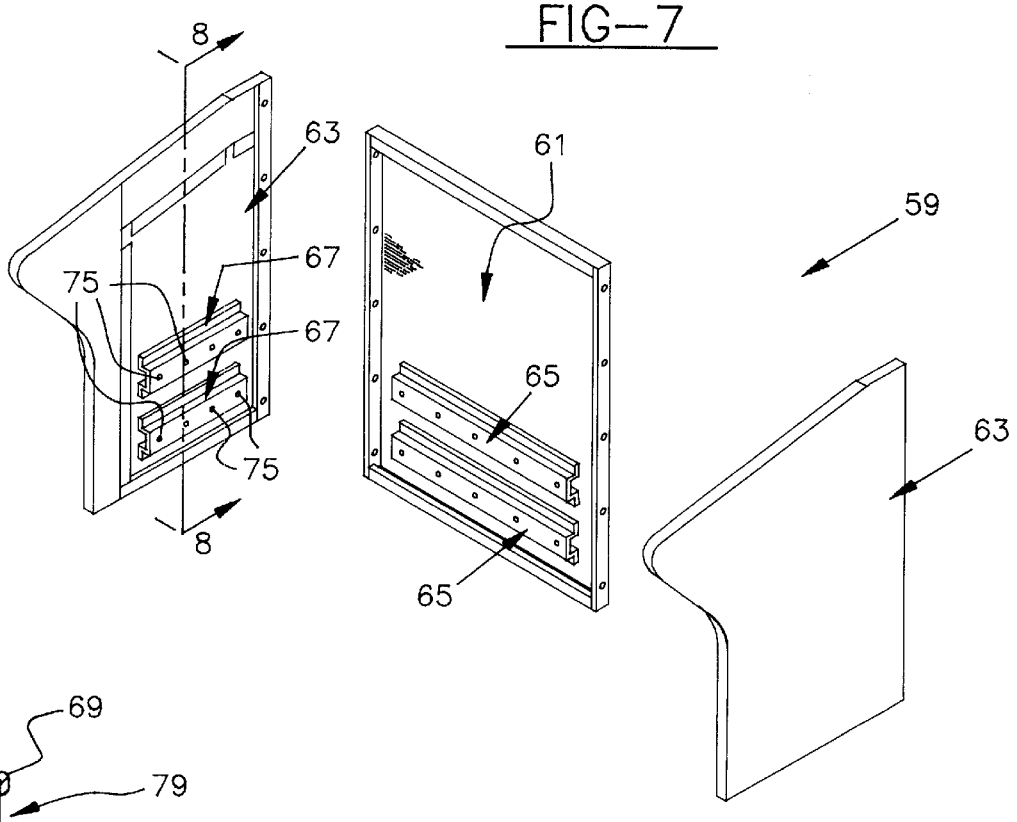
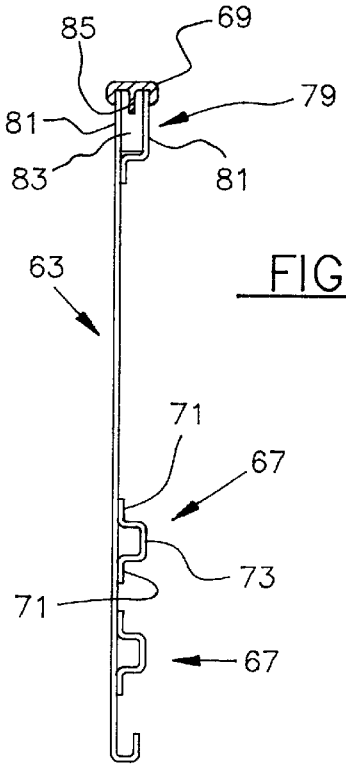
FIG—8
FIG—5
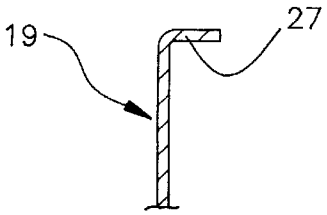
FIG—4
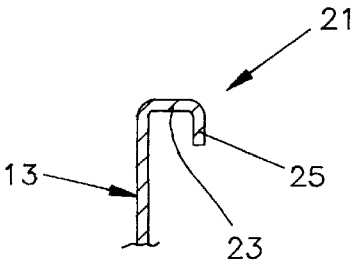

ENCLOSURE ASSEMBLY FOR THE EQUIPMENT OF A GAMING DEVICE OR THE LIKE

FIELD OF THE INVENTION

The present invention relates to cabinet-like enclosures which are comprised of pre-shaped panels that can be easily affixed together to form an enclosure.

DESCRIPTION OF THE PRIOR ART

The conventional way of providing cabinet enclosures for gaming devices such as video poker and slot machines, involves the fabrication of the cabinet at one location for delivery to another location where the device equipment is installed within the cabinet. Unfortunately, because the enclosure shell is box-shaped it cannot be efficiently stored, transported and shipped.

Also under prior techniques the component parts of the device enclosure have been connected by welding or by bolting, and unfortunately very often signs of the welding or fastening were visible, which, among other things, negatively effected the aesthetics of the finished device.

There also appears the need for a quicker, more reliable and efficient way for fabricating enclosure cabinets.

SUMMARY OF THE INVENTION

In view of the foregoing, it is a general object of the present invention to provide an enclosure cabinet for the equipment of a floor-standing device such as a gaming device, that can be fabricated quickly, efficiently and reliably.

Another object is to provide such a cabinet in the form of modular components that can be assembled quickly and accurately by a worker who is minimally skilled and trained.

A further object is to provide a cabinet enclosure that has an exterior view that does not expose the means by which the cabinet components are fastened together. Yet another object is to provide, for such a cabinet, generally flat modular components that can be easily and efficiently stored and transported.

A still further object is to provide modular components that can be easily and accurately aligned with each other during fabrication.

The foregoing and additional advantages are provided by the present intention of a modular assembly for an enclosure cabinet, the assembly including panels that are adapted to the affixed to each other quickly and easily and accurately to form an enclosure, each of the panels being generally rectangular and having a planar portion and a flanged edge on each side of the panel. The panel edges can be a double-bend edge comprising two right angle bends that provides an edge member that is spaced from and parallel to the planar portion. A second type of panel edge has a single edge member at right angels to the planar portion.

The assembly includes a top, bottom, back and opposing side panels and the top panel has double-bend front and rear edges, and single-member side edges. Each side panel has double-bend edges on all of its sides, and the bottom panel has a double-bend front edge and its remaining edges are single-member. There are a plurality of holes spaced apart along the edge members of each side panel, and a plurality of spaced-apart holes are also provided in the edge members of the back panel. The front edge members of the top and bottom panels are without holes; however, the remaining edge members are provided with spaced-apart holes. The panels have an assembled position for an enclosure wherein the edges of the back and side panels extend inwardly with respect to the enclosure, and the edges of the top and bottom panels extend downwardly. The plurality of holes along the respective panels are alignable with holes in adjoining ones of the panels and fasteners are affixed through these aligned holes to secure the aligned panels to each other to form a box-like enclosure having a front opening over which a swingable door can be mounted. The connections between panels involve double-bend edges mated with single-member edges.

BRIEF DESCRIPTION OF THE DRAWINGS

FIG. 4 is a sectional view taken along the line 4—4 of FIG. 2;

FIG. 5 is a cross-sectional view taken along the line 5—5 of FIG. 3;

FIG. 7 is an exploded perspective view of a variant of the invention; and

FIG. 8 is a sectional view taken along the line 8—8 of FIG. 7.

DETAILED DESCRIPTION OF THE INVENTION

Figure 1:
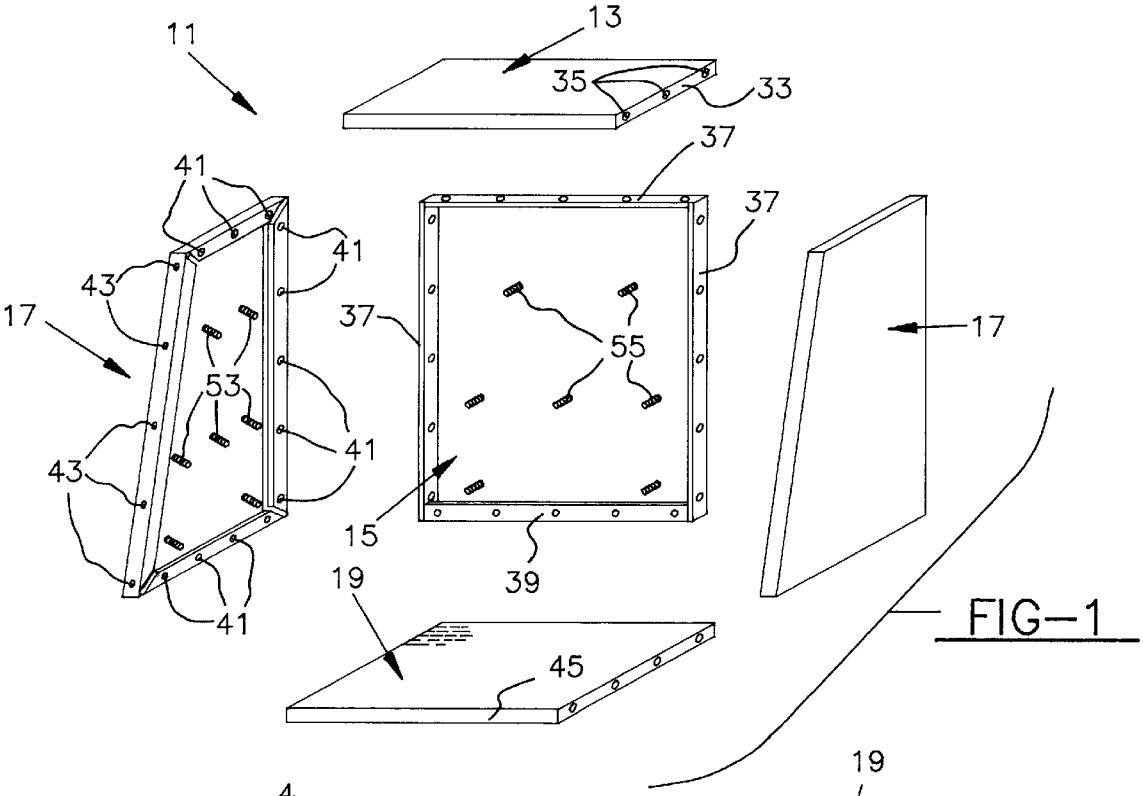
FIG. 1 an exploded perspective view of an enclosure assembly according to the present invention.

Referring now to the drawings, FIG. 1 shows that a preferred embodiment of an enclosure assembly 11 according to the present invention includes a top panel 13, back panel 15, opposing side panels 17, and bottom panel 19. The foregoing panels are fabricated of a suitable sheet metal using techniques well known in the metal forming industry, and each panel is four-sided, having a planar flat portion in a specially formed edge along each of its sides. In a unique manner the invention combines in each panel, in a predetermined manner, two types of edges. One edge is a double-bend edge such as edge 21 shown in FIG. 4, by way of example, formed of two right-angle turns to provide a first edge member 23 and another edge member 25 that is spaced parallel from the planar portion of the panel. The other type of panel edge is illustrated in FIG. 5, and features a single edge member 27 at right angles to the panel planar portion. It will be seen that the panels comprising the assembly 11 will be provided with a certain arrangement of edges and spaced holes along these edges such that the various panels can be expeditiously aligned and fastened together in a most advantageous manner. Note that top panel 13 has double-turn front and rear edges, and that rear edge member 29 is provided with spaced-apart holes 31, and its side edges have single-edge members 33 that are provided with spaced-apart holes 35, as shown in FIGS. 1 and 2.

The rear panel 15 has single-member edges 37 on all sides except the bottom which has a double-bend edge 39, the edges 37 and 39 having arrays of holes as FIG. 1 depicts.

The side panel 17 are mirror images of each other, and they have double-bend edges on all sides, and the top, bottom and rear-edged members are provided with holes 41 as also shown in FIG. 1. The front edge holes 43 are for the fastening of a door (not shown) for the assembled device.

Figure 2:
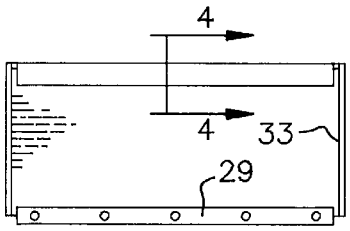
FIG. 2 is a bottom plan view of a top panel of an assembly according to the invention.
Figure 3:
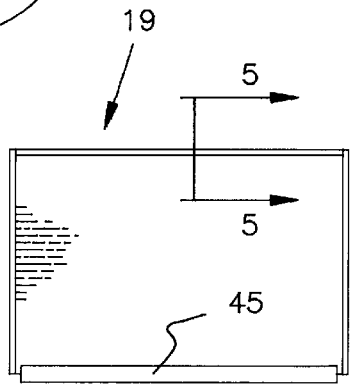
FIG. 3 is a bottom plan view of a bottom panel according to the present invention.

Finally as FIGS. 1 and 2 show, the bottom panel 19 has a double-bend front edge 45, and the remaining edges are single-member edges having spaced-apart holes there along.

Figure 6:
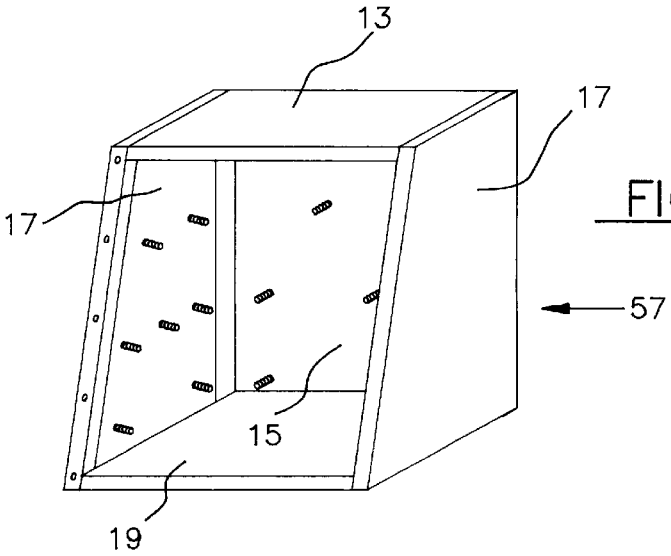
FIG. 6 is a perspective view of an assembled enclosure according to the invention.

As FIG. 1 also shows, the left side panel 17 has a number of metallic studs that are affixed by suitable means such as welding to the inside of panel 17. They extend horizontally for a distance slightly less than the dept of the edges of the panel 17, and will serve as anchors for supporting equipment (not shown) within the completed enclosure. The right-side panel 17 is similarly equipped with anchor studs, and likewise the back-panel 15 is seen to have anchor studs 55. It will be seen that the panels shown in FIG. 1 in exploded view can be brought together in proper alignment to form the completed structure shown in FIG. 6, by attaching one panel, at a time, to an adjacent panel. Proper alignment is assured when the pre-punched holes of one panel edge are aligned with the pre-punched holes of the adjoining panel. For example, the holes 41 in the rear-edge of panel 17 are alignable with the holes in the side edge 37 of the back panel 15, which step properly aligns these two panels. Then pop rivets can be applied to the aligned holes, easily and conveniently using a suitable rivet tool. It is noted that in this, and all the other connections between panels, the flange of a double-bend edge, such as the flange 25 shown in FIG. 4, is mated with the edge member of a single-bend edge. Accordingly, pop rivets can be used to fasten together all of the component panels shown in FIG. 1 to form the completed enclosure 57 shown in FIG. 6. Because of the manner in which the panel edges are connected to each other, the pop rivets, or other suitable fasteners used, cannot be seen on the exterior of the completed enclosure 57.

A variant 59 of the invention is illustrated in FIGS. 7 and 8, wherein the side and back panels are similar to those described above regarding assembly 11, however back panel 61 and side panels 63 include the cross-supports 65 and 67 respectively. Also, sidewalls 63 feature double-walled structure for holding an edge molding 69, to be described. FIG. 8 best shows how a typical cross-support 67 has feet 71 welded to panel 63, and has a raised member 73 containing spaced-apart pre-punched holes 75. It should be appreciated how pre-punched holes in the single edge of a horizontal bottom panel or a shelf can be aligned with holes 75 and then attachment made using suitable pop rivet techniques. The cross-supports 65 are aligned at the same elevations as the cross-supports 67, and are similarly equipped with holes for being aligned with holes in single member edges of the bottom panel or a shelf (not shown). FIG. 8 also shows how sheet metal piece 79 is welded to panel 63 to provide a pair of spaced-apart walls 81 between which is secured a wooden insert 83, using a suitable adhesive. The top of insert 83 is provided with a longitudinally extending slot, and the molding 69, which is typically made of a flexible polymeric material, has a downward projection 85 that is engaged in the slot in order to secure molding 69 in place.

While particular preferred embodiments of the invention have been disclosed, it should be evident that various modifications of the invention can occur to those who are skilled in the art, given the benefit of this disclosure. Thus, it is intended that all such variations and modifications fall within the full scope and breadth of the invention as defined in the claims which follow.

What is claimed is:

1. An assembly for an enclosure for the equipment for a device including a plurality of generally rectangular panels each of said panels having a planar portion and said panels having double-bend edges where a panel periphery is bent through two right angles to provide an edge member spaced from and parallel to the panel planar portion, and single-bend edges comprising a single bend in the panel periphery to provide a single member perpendicular to the panel planar portion, and the assembly including:

a) a top panel having double-bend front and rear edge members and single bend side edge members, each of the side edge members having spaced-apart holes therein, and the rear edge member having spaced-apart holes therein;

b) a back panel having single bend top and side edge members that are provided with spaced-apart holes, and a double-bend bottom edge member having spaced-apart holes there along;

c) first and second side panels, a mirror image of each other, and each having double-bend edge members along top, bottom, front and rear sides with spaced-apart holes along the top, bottom, and rear edge members of the side panels;

d) a bottom panel having a double-bend front edge member, and single bend rear and side edge members having a plurality of spaced-apart holes therein;

e) whereby said top panel, bottom panel, first and second side panel and back panel can be affixed together in an assembled configuration to form said enclosure, and in said assembled configuration the edge members of said top and bottom panels point downwardly, and the edge members of said back and side panels point inwardly with respect to said enclosure, and whereby the holes in the side edge members of the bottom panel align respectively with said holes in the bottom edge member of the side panels, and the holes in the rear edge member of the bottom panel align with the holes in the bottom edge member of the back panel, said holes in the side edge members of said back panel align with said holes in the rear edge members of said side panels, and said holes in the side edge members of the top panel align with the holes in the top edge members of said side panels, and the holes in the rear edge member of said top panel align with said holes in the top edge member of said back panel; and, f) whereby fastening means are applicable through said holes of eddeletege member of said panels which have been aligned to secure said panels in said assembled configuration.

2. The assembly as defined in claim 1 whereby, in said assembled configuration, first-bend portions of said back and side panels provide downwardly facing co-planar surfaces for engaging a horizontal surface to support said enclosure.

3. The assembly as defined in claim 1 wherein said top panel has a flat top surface, and the top edge members of said side panels provide surfaces that are co-planar with the top surface of said top panel when the enclosure is assembled.

4. The assembly as defined in claim 3, wherein each of the side panels has a peripheral, marginal, double-walled portion comprising spaced-apart walls providing a cavity extending along said periphery, and opening outwardly, and a wooden insert secured in said peripheral cavity, and including a longitudinally extending polymeric molding secured to said insert to provide a longitudinally extending cover for said peripheral portion.

5. The assembly as defined in claim 1 including a plurality of spaced-apart attachment and support posts affixed to the planar portions of said back panel and said side panels, and extending horizontally and inwardly with respect to said enclosure, and each of said posts having a length that is less than a thickness of the edge members of each of said back panel and the side panels.

6. The assembly as defined in claim 1 wherein said fastening means comprise pop rivets.

7. The assembly defined in claim 1 wherein front edges of said assembled panels define a front opening for said enclosure, and including a door panel mounted to one of said side panels, for covering said opening.

8. The assembly as defined in claim 1 including a plurality of horizontally extending reinforcement members secured to the planar portion of said back and side panels, each of said reinforcement members having an inwardly raised, vertically aligned flat member, and said flat member provided with spaced-apart holes there along, and where said holes in said bottom panel are aligned with said holes in said enforcement members, and fasteners in said aligned holes securing said bottom panel to said reinforcement members.

* * * * *